United States Patent [19]

Lie

[11] 3,941,377

[45] Mar. 2, 1976

[54] APPARATUS FOR SIMULATED SKIING

[76] Inventor: Hakon Lie, Beitostolen Helsesportsenter, 2953 Beitostolen, Norway

[22] Filed: Nov. 19, 1974

[21] Appl. No.: 525,125

[52] U.S. Cl. ..... 272/57 B; 272/69

[51] Int. Cl.[2] ..... A63B 69/18

[58] Field of Search..... 35/29 R; 272/69, 70, 79 R, 272/57 B

[56] References Cited

UNITED STATES PATENTS

| | | | |
|---|---|---|---|
| 3,332,683 | 7/1967 | Rand | 272/69 |
| 3,408,067 | 10/1968 | Armstrong | 272/57 B |
| 3,711,090 | 1/1973 | Fiedler | 272/69 |
| 3,759,511 | 9/1973 | Zinkin et al | 272/79 R |

*Primary Examiner*—Paul E. Shapiro
*Assistant Examiner*—Joseph R. Taylor
*Attorney, Agent, or Firm*—Ladas, Parry, Von Gehr, Goldsmith & Deschamps

[57] ABSTRACT

Apparatus for simulated skiing having a pair of assemblies each comprising a frame, at least two rollers rotatably mounted in parallel for rotation in said frame, an endless flexible element mounted on said rollers for movement around said rollers, a foot plate, means for transmitting a skier's leg movements to said element, an adjustable brake to provide adjustable resistance to said movement of said element and one way drive means between said brake and said element to permit movement of said element free from said adjustable resistance in one direction, said frame having stop means restricting movement of said foot plate, said one way drive means comprising complimentary teeth on said element and a said roller, the teeth being shaped and oriented so as to overide one another in said one direction and drivingly to engage one another in the opposite direction, said brake acting upon said roller having teeth; and a pair of stave assemblies each comprising a frame, at least two rollers mounted in parallel for rotation in said frame, an endless flexible element mounted on said rollers for movement around said rollers and adapted for movement by arm movements of a skier transmitted thereto by staves, said stave assemblies each having an adjustable brake to provide adjustable resistance to the movement of the belts of that stave assembly.

4 Claims, 5 Drawing Figures

FIG. 3
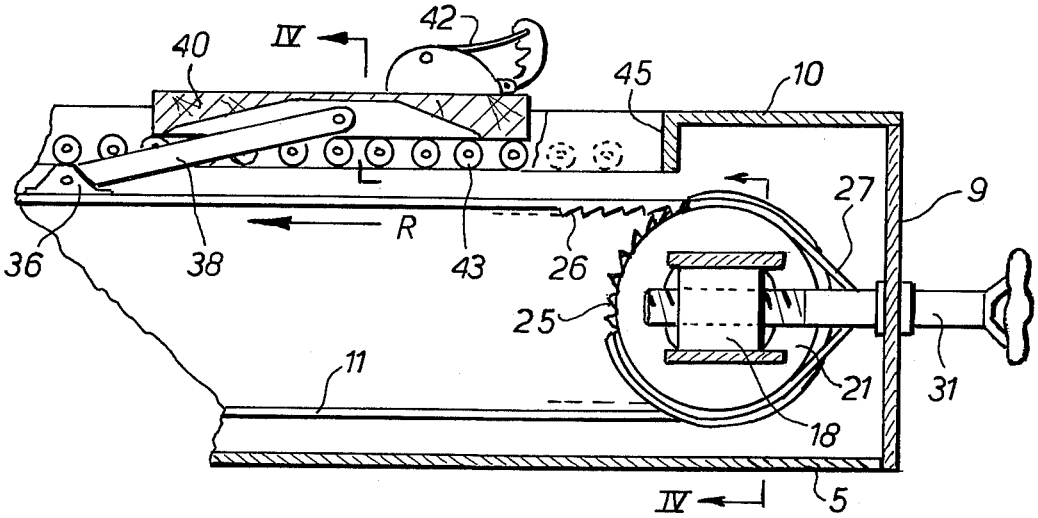
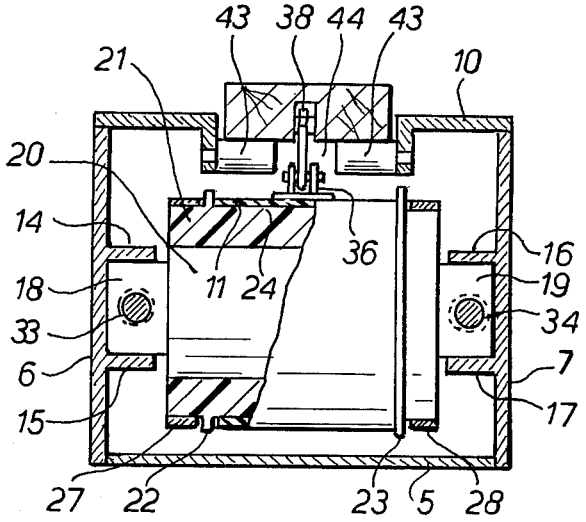
FIG. 4
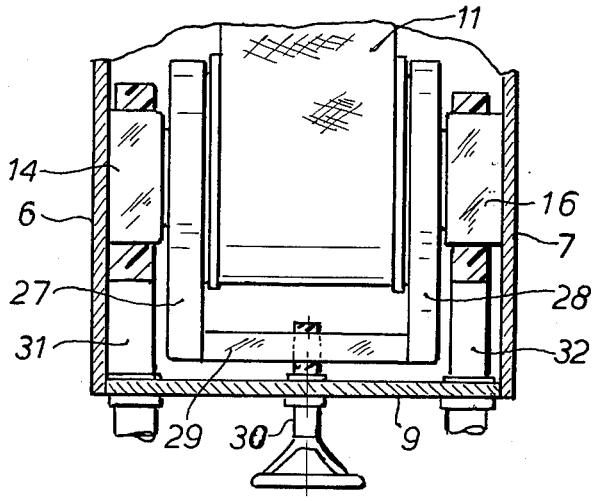
FIG. 5

APPARATUS FOR SIMULATED SKIING

The invention relates to an apparatus on which it is possible to carry out simulated skiing with variable loads. The apparatus is intended as physical training apparatus and for training for all types of cross country skiing.

With such an apparatus it is possible to execute movements identical to those carried out during cross country skiing with a resultant identical load on the various groups of muscles. The apparatus permits a graduated muscle load during constant frequency of rhythmic skiing movements.

Several types of roller skis have previously been constructed, intended for simulated skiing on roads. These are constructed such that the wheels on the roller skis rotate only in the direction of travel and are locked if an attempt is made to move in the opposite direction. This permits a good push-off. A deficiency of the said roller ski is that those predominantly used at the present time, with small, non-inflatable wheels, permit use only on good asphalted and ice-free roads, which have good illumination and little traffic. Skis having larger, inflatable wheels, which can be used also on gravel roads, are so heavy that a natural, free skiing movement is difficult. Simulated ski-run paths have also been proposed where an endless belt is used which runs over rollers.

The object of the invention is to provide an apparatus permitting ski training throughout the year, regardless of the geographical, climatic and communication conditions, and which can be executed in a minimum of space both indoors and outdoors. It is, therefore, an object to provide an apparatus suitable for use as training and physical training apparatus in small units such as treatment institutions (hospitals, physical institutes), ships, prisons, etc.

According to the invention this is achieved in that the apparatus has at least one pair of belts or chains for transmission of the leg movements of the skier via a pair of foot plates and/or a pair of belts or chains for transmission of the skier's arm movements via a pair of staves, the belt or chains being freely movable in one direction (forwardly) and movable against an adjustable resistance in the other direction (rearwardly), the said resistance being determined by a brake means with adjustable braking effect, the frames of the foot belts or chains being provided with an edge or the like which restricts the forward movements of the foot plates.

The advantage of the claimed invention is that it is possible to produce a relatively simple apparatus for simulated skiing. The apparatus consists of standardized units which will facilitate and rationalize production. The apparatus is further formed such that it can be produced in one single size, which can be used by all regardless of height and strength. The apparatus can be further simplified in that it consists of only two stave-grip sections or only two skiing sections.

An embodiment example of the invention is illustrated on the drawings where:

FIG. 3 shows: a section along the line III—III in FIG. 1.

FIG. 4 shows: a section along the line IV—IV in FIG. 3.

FIG. 5 shows: a cut-away view of the right end part of FIG. 3 seen from above.

Figure 1:
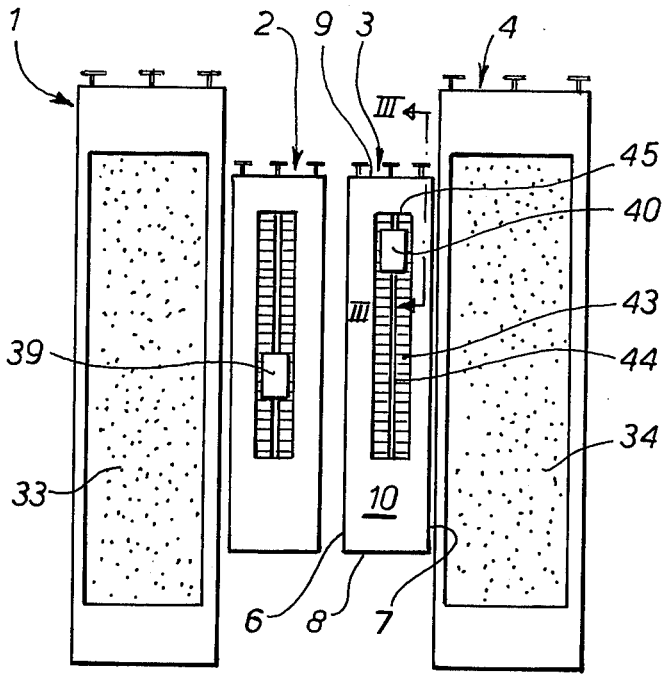
FIG. 1 shows: the apparatus seen from above.
Figure 2:
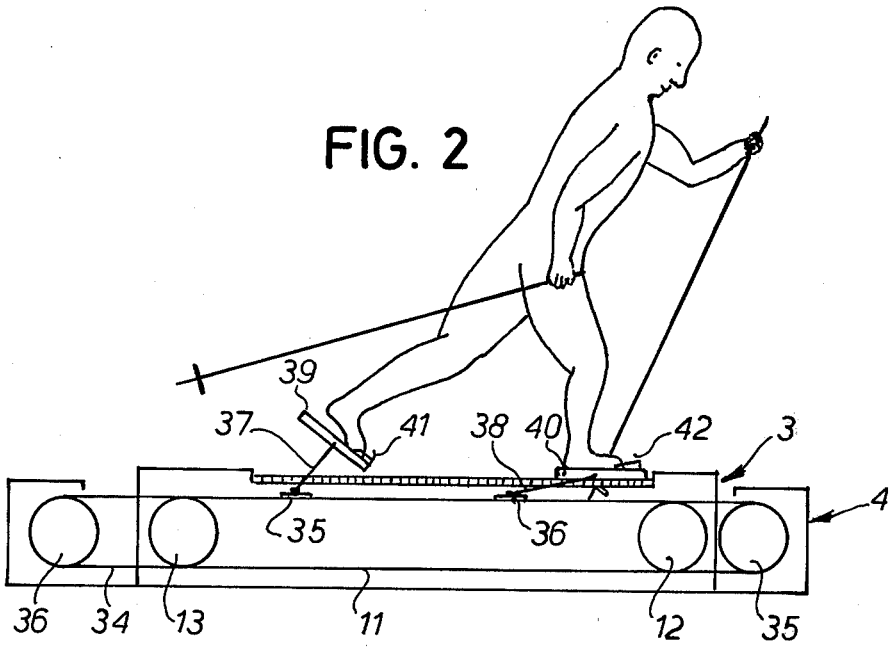
FIG. 2 shows: a diagrammatically view of the apparatus seen from the side.

In the embodiment example illustrated, the apparatus consists of four independent sections 1 – 4, two intended for stave grip, and two for the actual skiing. Each section has a box-like construction. The sections 1 and 4 for stave grips are somewhat longer than the sections 2 and 3 for skiing. The sections 1 – 4 may be secured to the base by means of suction cups (not shown) for indoor use, or spikes (not shown) for outdoor use. The sections are open in part at the upper side thereof.

Principally the sections 1 – 4 are of the same construction and thus only the skiing section 3 will be more specifically described.

As stated, the section 3 has a box-like construction, having a bottom wall 5, side walls 6 and 7, end walls 8 and 9, and a partly open top wall 10.

A belt 11 is laid around two rollers 12 and 13, in the box 3. The forward roller 12 is mounted regulable in the box, thereby acting as a belt tensioning roller, and is also provided with a braking mechanism. The inner sides of the side walls 6 and 7 are each provided with a pair of protusions 14, 15 and 16, 17 acting as guides for the ends 18, 19 respectively of a shaft 20. The main part of this shaft 20 is circular cylindrical, whereas the shaft ends 18, 19 are square in cross section. A cylindrical body 21, preferably of a suitable plast material, is rotatably mounted on the cylindrical part of the shaft 20. The cylindrical body 21 has two circumferentially extending flanges or ridges 22, 23, confining between them a roller surface 24 for the belt 11. This roller surface 24 is as shown in FIG. 3 provided with teeth 25 which coact with corresponding teeth 26 on the underside of the belt 11. A brake band 27, 28 is slung around the cylindrical body 21, between each body end and the adjacent flange 22 resp. 23. The brake bands 27, 28 are connected to a yoke 29 (FIG. 5). A spindle 30, which is rotatably mounted in an opening in the end wall 9, has a threaded section which coacts with a thread bore in the yoke 29. Thus, when the belt 11 moves rearwardly, arrow R, the cylindrical body 21 is rotated with an adjustable friction against the brake bands 27, 28, while the belt, on forward movement, runs freely, since the teeth 26 on the belt 11 then slip over the teeth 25 on the body 21.

The tension in the belt 11 is regulated by means of two spindles 31, 32, each being rotatably mounted in the end wall 9 and having a threaded section coacting with a thread bore 33, 34 in the shaft ends 18, 19.

The roller 13 is preferable comprising a cylindrical body having a smooth surface and being rotatably mounted on a shaft secured to the side walls 6 and 7. The roller 13 may, however, be of the same construction as the roller 12 described above.

The belt assembly in the sections 1 and 4 are as already stated of the principal construction. The belts 33, 34 have however, no teeth on the underside and consequently the rollers 35, 36 have smooth surfaces engaging the belts. This is so because the belts 33, 34 are moved in one direction only and it is not necessary to provide for a brake free return of the belts 33, 34.

The belts 33, 34 are disposed with their upper sides freely exposed on the upper side of the box with respect to the part of the belt which at all times is located between the brake roller in front and the free roller to the rear. The belt moves rearwardly against the graduated resistance in that the stave spike is stuck into the surface of the belt (within the portion which runs freely exposed), and the actual stave holding movement conveys the belt rearwardly. The movements are the inverse of those normally taking place when skiing; the base moves rearwardly whilst the skier remains in the same place. The surface of the belts 33, 34 must be of a type such that the belt can withstand repeated piercing by the stave spike, and the belt must also provide a good grip for the stave.

In regard to the skiing sections 2 and 3 located between the two stave grip sections 1 and 4, the belt 11 is concealed throughout its length within the box. On the belt 11, at a location on its upper outer surface, a securing point 35, 36 is provided connected to a rod 37, 38 which, through a longitudinal slot 44 on the upper side of the box, is secured to a foot plate 39, 40. On the upper side of the said foot plates, the ski boots are secured in a cross country binding 41, 42. The foot plate rests on two roller sets 43, forming between them the said longitudinal slot 44 from which the rod for the foot plate projects. On push-off, the inverse of what takes place on skiing is again undertaken; the body is stationary whilst the foot moves rearwardly on the base. The movement will be the same, however. On push-off, the foot plate 6 is moved rearwardly on the roller sets 43. The force is transmitted via the rod 37, 38 to the securing point on the belt 11 which is then moved rearwardly against an adjustable resistance. The rods 36, 37 are mounted both in the securing point 35, 36 on the belt and in the foot plate 39, 40. The rods are positioned obliquely downwardly and rearwardly from the foot plates to the securing points and, on termination of the push-off, the foot plate can be moved up over the base and angled with respect thereto. This allows a natural and free terminating movement of the push-off. When the leg and the foot plate are again moved forwardly, the belt is also pulled forwardly via the securing point, however, this movement is freely carried out since the teeth 26 on the belt 11 slip over the teeth 25 on the roller body 21. In that the foot, after push-off, is moved forwardly on line with the other foot, the push-off of the other leg takes place. The push-off, in this manner — precisely as in skiing — is undertaken while the feet are placed together and the push-off is carried out at the forward end of the roller bearing frames since the fore edge of the foot plate will strike against an edge 45 in the section top wall.

The sections 1 – 4 may be bolted together (not shown). Using bolts it will be possible to vary the distance between the skiing sections 2 and 3 and the distance therebetween and the stave grip sections 1 and 4, depending on the skier's height and natural ski track width.

Having thus described my invention, I claim:

1. Apparatus for simulated skiing comprising a pair of assemblies each comprising a frame, at least two rollers rotatably mounted in parallel for rotation in said frame, an endless flexible element mounted on said rollers for movement around said rollers, a foot plate assembly adapted to accommodate and support a skier's foot, means for transmitting a skier's leg movements from said foot plate to said element, an adjustable brake to provide adjustable resistance to said movement of said element and one way drive means between said brake and said element to permit movement of said element free from said adjustable resistance in one direction, said frame having stop means restricting movement of said foot plate.

2. Apparatus according to claim 1 wherein said one way drive means comprises complimentary teeth on said element and a said roller, the teeth being shaped and oriented so as to overide one another in said one direction and drivingly to engage one another in the opposite direction, said brake acting upon said roller having teeth.

3. Apparatus according to claim 1 comprising a pair of stave assemblies each comprising a frame, at least two rollers mounted in parallel for rotation in said frame and an endless flexible element mounted on said rollers for movement around said rollers and adapted for movement by arm movements of a skier transmitted thereto by staves.

4. Apparatus according to claim 3 wherein said stave assemblies each have an adjustable brake to provide adjustable resistance to the movement of the belts of that stave assembly.

* * * * *